United States Patent [19]

Rothwell, Jr. et al.

[11] Patent Number: 5,043,634

[45] Date of Patent: Aug. 27, 1991

[54] PULSED LIGHT SOURCE

[75] Inventors: Harold L. Rothwell, Jr., Georgetown, Mass.; Peter J. Van Peenen, Traverse City, Mich.; George J. English, Reading, Mass.

[73] Assignee: GTE Products Corporation, Danvers, Mass.

[21] Appl. No.: 212,401

[22] Filed: Jun. 27, 1988

[51] Int. Cl.[5] ..... H05B 41/16

[52] U.S. Cl. ..... 315/246; 315/219; 315/209 R; 313/25; 313/163

[58] Field of Search ..... 315/244, 246, 219, 209; 313/25, 487, 163, 232, 171, 34; 307/311; 250/227.11

[56] References Cited

U.S. PATENT DOCUMENTS

| | | | |
|---|---|---|---|
| 1,042,565 | 10/1912 | Kroner | 313/25 |
| 1,064,115 | 6/1913 | Weintraub | 313/25 |
| 2,902,618 | 9/1959 | Lang et al. | 313/163 |
| 4,065,688 | 12/1977 | Thornton . | |
| 4,173,728 | 11/1979 | Witting | 313/163 |
| 4,245,155 | 1/1981 | Witting | 313/163 |

FOREIGN PATENT DOCUMENTS

| | | |
|---|---|---|
| 7518714 | 6/1975 | France . |
| 56-76157(A) | 7/1981 | Japan . |
| 763446 | 12/1956 | United Kingdom . |
| 2178230A | 2/1987 | United Kingdom . |

*Primary Examiner*—Michael Razavi

*Attorney, Agent, or Firm*—Joseph S. Romanow

[57] ABSTRACT

A pulsed light source includes a sealed, ultraviolet-transmissive lamp tube defining a discharge region containing a rare gas or a mixture of rare gases, anode and cathode electrodes sealed into the lamp tube at opposite ends, leads for connecting the electrodes to a pulsed source of electrical energy and a phosphor material located on a surface external to the discharge region. The lamp tube contains mercury in sufficient quantity to cover the cathode electrode when the lamp tube is oriented with the cathode electrode at the bottom. The cathode electrode is protected by the mercury from sputtering that results from ion bombardment. The mercury emits pulsed ultraviolet radiation which stimulates emission of visible light by the phosphor material. Lamp tube pressure is below 200 torr. The light source is operable over a range of pulse widths and duty cycles. The color of light emission is determined by the phosphor. The phosphor can be located on the outer surface of the lamp tube or on a separate glass sleeve.

23 Claims, 2 Drawing Sheets

PULSED LIGHT SOURCEGOVERNMENT RIGHTS

The Government has rights in this invention pursuant to Contract No. DTCG23-87-C-20026 awarded by the United States Coast Guard.

FIELD OF THE INVENTION

This invention relates to pulsed light sources and, more particularly, to low pressure pulsed light sources that are operable over a range of pulse widths and duty cycles and are available in a variety of different colors. The pulsed light source of the present is particularly useful as a navigation aid, but is not limited to such use.

BACKGROUND OF THE INVENTION

The need frequently arises for high intensity pulsed light sources. Pulsed light sources are typically used for signaling applications such as marine navigation, airport signaling and vehicle signaling. Such pulsed light sources are required in different colors and are required to operate over a range of duty cycles and pulse widths. In addition, the pulsed light source must have high intensity and a long operating life.

Light sources designed for continuous use often do not operate satisfactorily in a pulsed mode, since continuous light sources usually require a warmup period and operate most efficiently at elevated temperatures. When a light source designed for continuous use is operated in a pulsed mode, the desired operating temperature is never reached.

The lamps most commonly used for pulsed applications are high pressure, rare gas lamps such as xenon flashlamps. The pressure within the lamp tube may be 20 atmospheres or more at room temperature. Xenon flashlamps have a number of disadvantages. Since they are high pressure lamps, there is a risk of explosion. Such lamps must be carefully handled and must be operated in an enclosure. In addition, xenon flashlamps produce very short light pulses, on the order of microseconds, due to a self-extinguishing characteristic. The duration of the light pulse cannot be lengthened appreciably. The short light pulses are a problem in applications, such as navigation, where the human eye is required to locate the light source. The human eye perceives the short light pulse, but is unable to localize it.

A further drawback of high pressure xenon and other high pressure rare gas lamps is sputtering of electrodes which limits operating life. The sputtering occurs due to bombardment of the cathode by energetic ions within the lamp envelope.

Tungsten filament lamps can be utilized in pulsed applications. However, tungsten filament lamps do not provide the desired efficiency and have a limited life, particularly in applications subject to mechanical shock, such as aircraft and shipboard applications.

It is well-known to use mercury as a fill material in discharge lamps. Upon excitation, mercury produces ultraviolet radiation. A number of prior patents have disclosed discharge devices utilizing a pool of mercury sealed within the discharge envelope. These patents include U.S. Pat. Nos. 1,225,332 (Hewitt); 1,451,271 (Rentschler); 1,554,720 (Ferguson); 1,267,199 (Ferguson); 1,943,847 (Spaeth); 2,841,731 (DeLany et al); 1,903,494 (Beck); and 1,903,495 (Beck). It is believed that all of the disclosed devices were intended for continuous use or were intended for applications other than lighting.

It is a general object of the present invention to provide improved pulsed light sources.

It is another object of the present invention to provide a pulsed light source having a long operating life.

It is a further object of the present invention to provide a pulsed light source that can be operated over a range of light pulse widths and duty cycles.

It is yet another object of the present invention to provide a pulsed light source that can easily be provided in different colors.

It is still another object of the present invention to provide a low pressure, pulsed light source.

It is a further object of the present invention to provide a pulsed light source that is operated at or near ambient temperature.

It is a further object of the present invention to provide a pulsed light source having a combination of the above features.

It is yet another object of the present invention to provide a pulsed ultraviolet radiation source.

SUMMARY OF THE INVENTION

According to the present invention, these and other objects and advantages are achieved in a pulsed light source comprising a sealed, ultraviolet-transmissive lamp tube defining a discharge region containing a rare gas or a mixture of rare gases, an anode electrode and a cathode electrode sealed into the lamp tube at spaced-apart locations and means for connecting the electrodes to an external pulsed source of electrical energy. The lamp tube contains a conductive material that is a liquid at or near room temperature, in sufficient quantity to cover the cathode electrode when the lamp tube is oriented in a normal operating position with the cathode electrode at the bottom. The conductive material is preferably mercury. The mercury is responsive to excitation from the pulsed source to emit pulsed ultraviolet radiation. The pulsed light source further includes a phosphor material located on a surface external to the discharge region. The phosphor material is responsive to the pulsed ultraviolet radiation to emit visible light having a color determined by the characteristics of the phosphor material.

The light source of the present invention is a low pressure device. In a preferred embodiment, the lamp tube contains argon at a pressure of 200 torr or less. The mercury forms a pool around the cathode electrode and protects it from sputtering. When the light source is pulsed, bombardment of the mercury pool by ions is believed to cause splashing of the mercury from the surface. The mercury dispersed in the lamp tube emits ultraviolet radiation.

The lamp tube is typically an elongated fused silica tube having electrodes mounted at opposite ends thereof. In a preferred embodiment, the lamp tube is shaped in the region of the cathode electrode to define a small volume capillary tube around the cathode electrode, thereby limiting the volume of mercury necessary to cover the cathode electrode during operation.

The phosphor material can be a coating on the external surface of the lamp tube. Alternatively, the phosphor material can be a coating on a glass sleeve positioned around the lamp tube. Conventional phosphors can be selected to provide red, green, yellow and other colors.

The pulsed light source of the present invention can be operated over a wide range of pulse widths and duty cycles. Preferably, the pulse width is in the range of about 1.0 millisecond to 500 milliseconds. The principal restriction on duty cycle and pulse width is to limit temperature and pressure rise in the lamp tube.

BRIEF DESCRIPTION OF THE DRAWINGS

For a better understanding of the present invention together with other and further objects, advantages and capabilities thereof, reference is made to the accompanying drawings which are incorporated herein by reference and in which.

DETAILED DESCRIPTION OF THE INVENTION

Figure 1:
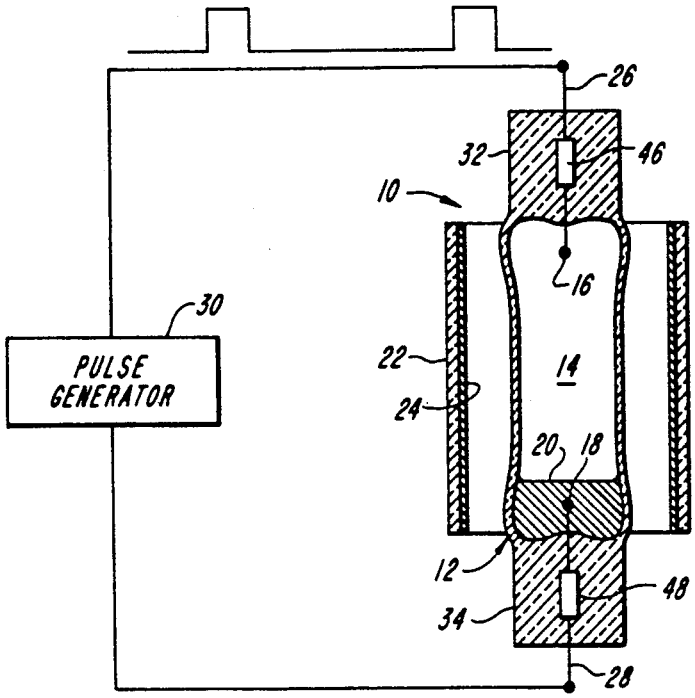
FIG. 1 is a simplified elevation view of a pulsed light source in accordance with the present invention.

A pulsed light source 10 in accordance with the present invention is shown in FIG. 1. A sealed lamp tube 12 encloses a discharge region 14 that contains a rare gas or a mixture of rare gases. An anode electrode 16 is sealed in one end of the lamp tube 12, and a cathode electrode 18 is sealed in the opposite end of the lamp tube 12. During normal operation, the lamp tube 12 is oriented generally vertically so that the anode electrode 16 is at the top and the cathode electrode 18 is at the bottom. In an important feature of the invention, the lamp tube contains a conductive material 20 that is a liquid at or near room temperature. Preferably, the conductive material 20 is mercury. The mercury is present in sufficient quantity to form a pool at the lower end of the lamp tube 12 which covers cathode electrode 18. A transparent sleeve 22, having a phosphor coating 24 thereon, is positioned around lamp tube 12. During operation, the electrodes 16 and 18 are connected by in-leads 26 and 28, respectively, to a pulse generator 30. The pulse generator 30 provides pulse excitation of suitable voltage and current to energize light source 10 in a pulsed mode, as described hereinafter.

In the case where the conductive material 20 is mercury, the pulsed radiation from the lamp tube 12 is ultraviolet radiation. In this case, the lamp tube 12 must be an ultraviolet-transmissive material such as fused silica (quartz). Preferably, the lamp tube 12 is formed in an elongated configuration with electrodes 16 and 18 mounted near opposite ends thereof. In a preferred embodiment, the lamp tube 12 is sealed in conventional manner by press seals 32 and 34. The discharge region 14 preferably has cylindrical geometry with dimensions in the range of about 3 to 12 millimeters in length by 4 millimeters inside diameter, but is not limited to these dimensions. Although wall thickness is not critical, the lamp tube 12 preferably has a wall thickness of about one millimeter.

Figure 2:
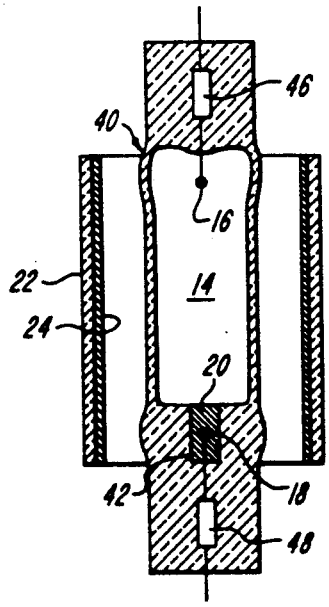
FIG. 2 is an elevation view of another embodiment of the pulsed light source.

An alternate embodiment of the lamp tube is illustrated in FIG. 2. The light source of FIG. 2 is generally the same as the light source 10 of FIG. 1 except for the configuration of the lamp tube. A lamp tube 40 has electrodes 16 and 18 mounted at opposite ends thereof. The lower end of lamp tube 40 is shaped to define a recess 42 surrounding cathode electrode 18. Recess 42 is made as small in volume as possible without interfering with lamp operation. The purpose of the small volume recess 42 is to insure that the cathode electrode 18 is covered with mercury in the normal operating position, while minimizing the volume of mercury within lamp tube 40. It is desirable for safety and cost reasons to minimize the volume of mercury within the lamp tube 40.

The electrode 16 is preferably tungsten, but can also be rhenium or other similar high temperature metals. Electrode 18 can be any metal compatible with mercury. Shaping of electrodes 16 and 18 is not required. The in-leads 26 and 28, which are connected to electrodes 16 and 18, respectively, carry pulsed energy into sealed lamp tube 12. In a preferred embodiment, in-leads 26 and 28 are coupled to electrodes 16, 18, respectively, through press seals 32 and 34 by molybdenum ribbons 46 and 48 in conventional manner. Preferably, the spacing between electrodes 16 and 18 is in the range of about 3 millimeters to 12 millimeters, although other electrode spacings can be utilized within the scope of the present invention.

As noted above, the discharge region 14 includes a low pressure rare gas or a mixture of rare gases. Preferably, the fill gas has a pressure in the range of about 50 torr to 200 torr. At pressures above 200 torr, emission of ultraviolet radiation is quenched. In a preferred embodiment, the fill material is argon at a pressure of about 50 torr.

Mercury is the preferred conductive material for covering cathode electrode 18, since it is a liquid at room temperature. Other metals, conductive compounds and alloys that are liquid in form at or near room temperature or have a flowable or viscous characteristic at room temperature can also be utilized. Examples of such materials include indium, zinc, cesium, lithium and various amalgams. The selected conductive material during discharge emits ultraviolet radiation for stimulation of phosphor coating 24 and, in some cases, may emit useful visible light.

The main purpose of the mercury or other conductive material that surrounds cathode electrode 18 is to protect cathode electrode 18 from sputtering during operation. It is known that the relatively heavy ions within the discharge region 14 bombard the cathode electrode 18 in the absence of mercury 20, due to the electric fields in the lamp tube. The pool of mercury 20 surrounding cathode electrode 18 protects the cathode electrode 18 against such sputtering. Although the mercury is sputtered by ion bombardment, it returns to its original state without damage. Furthermore, the ion bombardment causes miniature droplets of mercury to be splashed into discharge region 14 and to take part in the discharge that occurs when the lamp is pulsed. As a result, more mercury is available to participate in the discharge than would otherwise be available as a result of the normal vapor pressure of mercury within the lamp tube.

Ultraviolet radiation from the discharge region 14 passes through lamp tube 12 and stimulates emission of visible radiation from phosphor coating 24. Phosphor coating 24 can be any of a variety of well-known phosphors and is selected to provide a desired color. Examples of suitable phosphors include $YVO_4$:Eu (red) and YAG:Ce (yellow). The transparent sleeve 22 that carries phosphor coating 24 is typically glass and can have any desired configuration. The mounting details of sleeve 22 are omitted for simplicity since they are routine to those skilled in the art. For example, the sleeve 22 can be part of a transparent outer lamp envelope.

Figure 3:
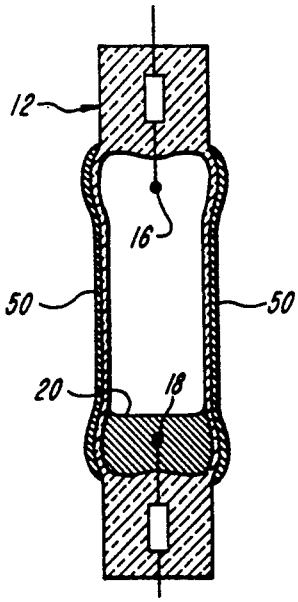
FIG. 3 is an elevation view of yet another embodiment of the pulsed light source.

The pulsed light source of the invention is not limited to use of a phosphor coating on the transparent sleeve 22, as shown in FIG. 1. An alternate phosphor configuration is illustrated in FIG. 3. A phosphor coating 50 is adhered to the outer surface of lamp tube 12. The phosphor coating 50 emits visible light upon stimulation by ultraviolet radiation from discharge region 14. Since the pulsed light source of the invention remains at or near ambient temperature during operation, the phosphor coating 50 is not exposed to elevated temperatures. The construction of the pulsed light source shown in FIG. 3 is otherwise the same as that shown in FIG. 1 and described hereinabove.

The pulse generator 30 supplies pulsed electrical excitation to the light source 10, and is connected so that anode electrode 16 is pulsed to a positive potential relative to cathode electrode 18. The operating conditions are selected to prevent the light source 10 from reaching elevated pressures and temperatures at which operating efficiency is reduced. A wide range of pulse widths, repetition rates and duty cycles can be utilized without violating this restriction. Pulse widths are preferably in the range from about 1.0 millisecond to 500 milliseconds. The light source can be utilized to provide a continuous series of pulses. In another operating mode, the light source 10 can be utilized to provide a burst of pulses, for example, a two second burst of 5 millisecond pulses having a 50% duty cycle. The pulse burst appears as a single, two-second pulse. In yet another operating mode, the light source 10 can be utilized to send coded signals such as Morse code or the like. A typical operating condition utilizes a 100 millisecond pulse at a repetition rate of once per second.

The light source 10 requires no warmup time and has a very fast recovery after the discharge is extinguished. The voltage drop across the light source 10 during discharge depends on the gap between electrodes 16 and 18 and on the pressure of the gas fill. A typical operating voltage is about 20 volts. The operating current is typically in the range from about 0.2 amp to more than 2 amps.

The pulse generator 30 is a ballast-type source that limits the current through the light source 10 at a desired operating value. The operating voltage is established by the characteristics of the light source 10. In addition, the pulse generator 30 provides means for initiating the discharge within light source 10. In a preferred embodiment, the discharge is initiated by a high voltage, short duration voltage spike on the order of 200 to 2,000 volts. The starting voltage spike is provided at the beginning of the energizing pulse. Other techniques for initiating discharges in low pressure discharge lamps are well-known to those skilled in the art. Any of a number of pulse generators that are well-known in the art can be utilized for energizing the light source 10.

Figure 4:
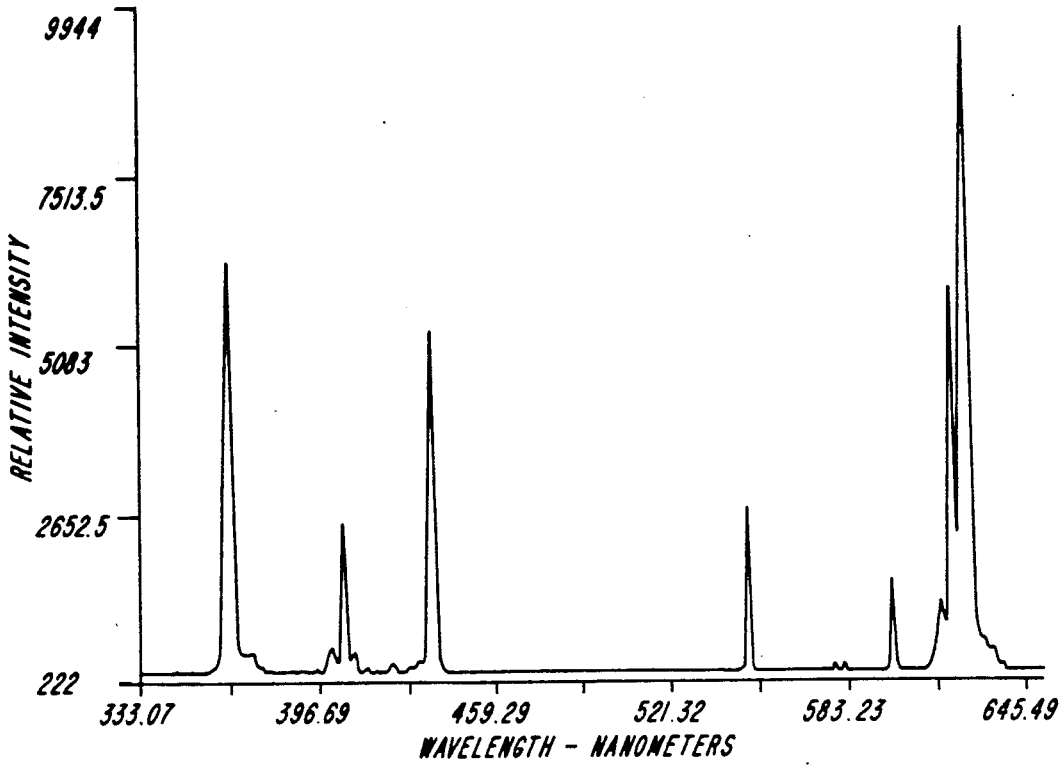
FIG. 4 is a graphic representation of the output spectrum of one example of the pulsed light source.
Figure 5:
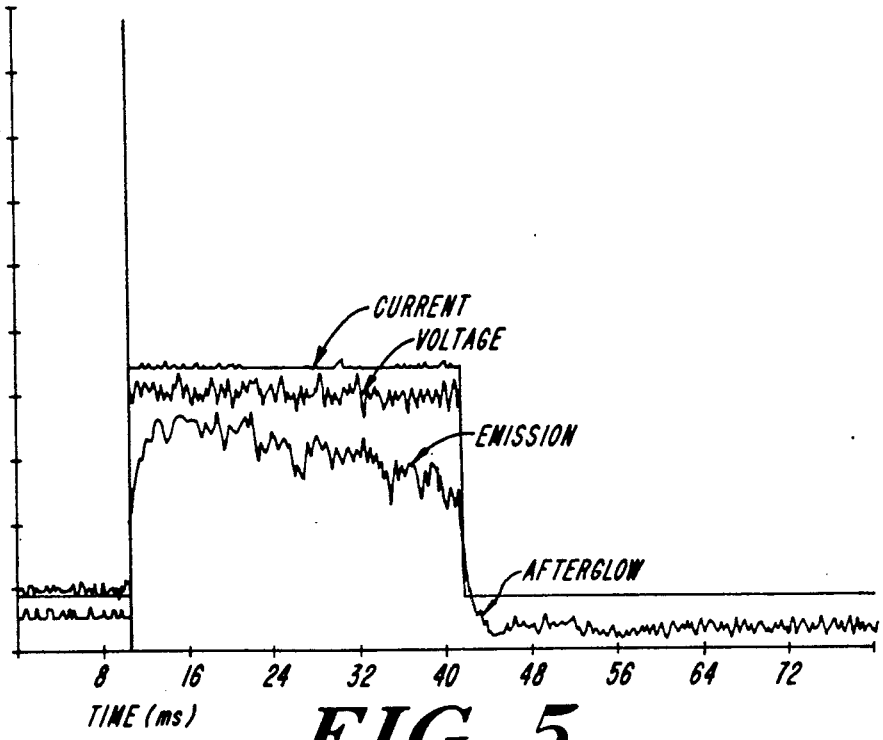
FIG. 5 is a graphic representation of voltage, current and light output waveforms associated with the pulsed light source of the present invention.

An example of the pulsed light source of the present invention was constructed as shown in FIG. 1. The electrode 16 and the surface of mercury 20 were spaced apart by a distance of 6 millimeters, and the fill material was argon at a pressure of 50 torr. The phosphor coating 24 was a red phosphor, type $YVO_4$:Eu. The quantity of mercury was sufficient to cover electrode 18. A graphic representation of the output spectrum is shown in FIG. 4, in which relative intensity of the output is plotted as a function of wavelength in nanometers. The contribution from the emission of the phosphor is primarily limited to a narrow band around 620 nanometers. The additional emission is from the mercury and argon within the lamp tube. The electrical and radiative characteristics are shown in FIG. 5. The current, voltage and light output waveforms are plotted as a function of time. The current pulse has an amplitude of about 0.5 ampere. The voltage pulse, after the initial starting spike, has an amplitude of about 20 volts. The light emission output in the band of interest is relatively constant during the applied pulse, and a measurable persistent emission occurs after the discharge has been extinguished. The persistence, or afterglow, is due to the stimulation and reradiation properties of the phosphor.

In a separate life test, the lamp was pulsed at a rate of four times per minute with power levels of approximately 25 watts during a 2 millisecond pulse. The source exceeded 800,000 pulses with no observable deterioration in the light output.

The pulsed light source of the present invention provides numerous advantages. The source is operated cold without auxiliary heaters or warmup time to achieve optimum performance. The light source of the invention is a low pressure device, thereby avoiding the potential hazards of high pressure devices. The light source is very simple in construction and chemical composition. A wide range of pulse widths and duty cycles can be utilized for operation of the light source. The electrode configuration of the source, wherein the cathode is immersed in a liquid conductor such as mercury, results in a long operating life without deterioration of the electrodes. A wide range of colors can be obtained by utilizing different phosphors with the ultraviolet light source. It will be understood that the pulsed source can be utilized without the phosphor when a pulsed ultraviolet radiation source is required.

While there has been shown and described what is at present considered the preferred embodiments of the present invention, it will be obvious to those skilled in the art that various changes and modifications may be made therein without departing from the scope of the invention as defined by the appended claims.

What is claimed is:

1. A pulsed visible light source comprising:

a sealed, ultraviolet-transmissive lamp tube defining a discharge region containing a rare gas or a mixture of rare gases;

an anode electrode and a cathode electrode sealed into said lamp tube at spaced-apart locations, and means for connecting said electrodes to an external pulsed source of electrical energy;

mercury in the liquid state without the application of auxiliary heat within said lamp tube in sufficient quantity to form a pool that covers said cathode electrode when said lamp tube is oriented in a normal operating position with said cathode electrode at the bottom;

a first quantity of mercury vapor within said discharge region, said first quantity of mercury vapor being responsive to pulsed excitation from said source of electrical energy to emit pulsed ultraviolet radiation;

during said pulsed excitation, a second quantity of mercury vapor within said discharge region, said second quantity of mercury vapor originating from liquid mercury splashed from said mercury pool above said cathode electrode by ion bombardment of said mercury pool, said second quantity of mercury vapor being responsive to pulsed excitation from said source of electrical energy to emit pulsed ultraviolet radiation; and a phosphor material located on a surface external to said discharge region, said phosphor material being responsive to said pulsed ultraviolet radiation from said mercury to emit visible light.

2. A pulsed light source as defined in claim 1 wherein said electrodes comprise tungsten.

3. A pulsed light source as defined in claim 1 wherein said lamp tube has a generally cylindrical shape and wherein said electrodes are located at opposite ends thereof.

4. A pulsed light source as defined in claim 1 wherein said cathode electrode is entirely submersed in said mercury in said normal operating position.

5. A pulsed light source as defined in claim 1 wherein said lamp tube comprises fused silica.

6. A pulsed light source as defined in claim 1 wherein said rare gas comprises argon at a pressure of less than 200 torr.

7. A pulsed light source as defined in claim 1 wherein said lamp tube comprises an elongated fused silica tube having said electrodes located at opposite ends thereof.

8. A pulsed light source as defined in claim 7 wherein said lamp tube includes press seals at opposite ends thereof and wherein said connecting means includes in-leads extending through said press seals and attached to said electrodes.

9. A pulsed light source as defined in claim 8 further including a glass sleeve around said lamp tube, said glass sleeve having a coating of said phosphor material thereon.

10. A pulsed light source as defined in claim 1 operated to prevent substantial rise above ambient values of temperature and pressure.

11. A pulsed light source as defined in claim 1 operated with a pulse width in the range of 1.0 millisecond to 500 milliseconds.

12. A pulsed light source as defined in claim 1 wherein said anode electrode and said cathode electrode are spaced apart by a distance in the range of about 3 millimeters to 12 millimeters.

13. A pulsed light source as defined in claim 1 wherein said phosphor material comprises a coating on an external surface of said lamp tube.

14. A pulsed light source as defined in claim 1 wherein said rare gas or said mixture of rare gases has a pressure in said lamp tube of less than about 200 torr.

15. A pulsed light source as defined in claim 7 wherein said lamp tube includes means defining a recess containing said cathode electrode, said recess having a smaller diameter than said lamp tube and containing said mercury.

16. A pulsed visible light source comprising:

a sealed, ultraviolet-transmissive lamp tube defining a discharge region containing a rare gas or a mixture of rare gases;

an anode electrode and a cathode electrode sealed into said lamp tube at opposite ends thereof;

source means for providing pulsed excitation and means for coupling said pulsed excitation to said electrodes;

said lamp tube containing mercury in the liquid state without the application of auxiliary heat in sufficient quantity to cover said cathode electrode when said lamp tube is oriented in a normal operating position with said cathode electrode at the bottom, said mercury being responsive to said pulsed excitation to emit pulsed ultraviolet radiation;

a first quantity of mercury vapor within said discharge region, said first quantity of mercury vapor being responsive to pulsed excitation from said source means to emit pulsed ultraviolet radiation;

during said pulsed excitation, a second quantity of mercury vapor within said discharge region, said second quantity of mercury vapor originating from liquid mercury splashed from said mercury pool above said cathode electrode by ion bombardment of said mercury pool, said second quantity of mercury vapor being responsive to pulsed excitation from said source means to emit pulsed ultraviolet radiation; and a phosphor material located on a surface external to said discharge region, said phosphor material being responsive to said pulsed ultraviolet radiation to emit visible light.

17. A pulsed light source as defined in claim 16 wherein said source means provides said pulsed excitation selected to prevent substantial rise above ambient temperature and pressure values.

18. A pulsed light source as defined in claim 16 wherein said source means provides said pulsed excitation having a pulse width in the range of 1.0 millisecond to 500 milliseconds.

19. A pulsed light source as defined in claim 16 wherein said source means provides said pulsed excitation such that said anode electrode is pulsed to a positive potential relative to said cathode electrode.

20. A pulsed ultraviolet radiation source comprising:

a sealed, ultraviolet-transmissive lamp tube containing a rare gas or a mixture of rare gases;

an anode electrode and a cathode electrode sealed into said lamp tube at opposite ends thereof, and means for coupling said electrodes to an external pulsed excitation source; and said lamp tube containing mercury in the liquid state without the application of auxiliary heat in sufficient quantity to cover said cathode electrode when said lamp tube is oriented in a normal operating position with said cathode electrode at the bottom, said mercury being responsive to said pulsed excitation source to emit pulsed ultraviolet radiation;

a first quantity of mercury vapor within said discharge region, said first quantity of mercury vapor being responsive to pulsed excitation from said source of electrical energy to emit pulsed ultraviolet radiation; and during said pulsed excitation, a second quantity of mercury vapor within said discharge region, said second quantity of mercury vapor originating from liquid mercury splashed from said mercury pool above said cathode electrode by ion bombardment of said mercury pool, said second quantity of mercury vapor being responsive to pulsed excitation from said source of electrical energy to emit pulsed ultraviolet radiation.

21. A pulsed ultraviolet radiation source as defined in claim 20 wherein said lamp tube comprises an elongated fused silica tube having said electrodes located at opposite ends thereof.

22. A pulsed ultraviolet radiation source as defined in claim 20 wherein said rare gas or said mixture of rare gases has a pressure in said lamp tube of less than about 200 torr.

23. A pulsed ultraviolet light source as defined in claim 20 wherein said electrodes comprise tungsten.

* * * * *